US010907635B2

(12) United States Patent
Oh

(10) Patent No.: US 10,907,635 B2
(45) Date of Patent: Feb. 2, 2021

(54) ELECTRIC COMPRESSOR

(71) Applicant: HYUNDAI MOBIS CO., LTD., Seoul (KR)

(72) Inventor: Hae Jin Oh, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 274 days.

(21) Appl. No.: 16/039,107

(22) Filed: Jul. 18, 2018

(65) Prior Publication Data

US 2019/0032974 A1 Jan. 31, 2019

(30) Foreign Application Priority Data

Jul. 28, 2017 (KR) ..... 10-2017-0095859

(51) Int. Cl.

| | |
|---|---|
| ***F25B 43/00*** | (2006.01) |
| ***F04C 29/04*** | (2006.01) |
| ***F04C 28/28*** | (2006.01) |
| ***F04C 18/02*** | (2006.01) |
| ***F01C 21/02*** | (2006.01) |

(Continued)

(52) U.S. Cl.

CPC ..... *F04C 29/028* (2013.01); *F01C 21/02* (2013.01); *F04C 18/0207* (2013.01); *F04C 28/28* (2013.01); *F04C 29/04* (2013.01); *F25B 43/00* (2013.01); *F04C 2210/26* (2013.01); *F04C 2240/30* (2013.01); *F04C 2240/50* (2013.01);

(Continued)

(58) Field of Classification Search

CPC ..... F01C 21/02; F04C 29/04; F04C 29/028; F04D 29/40; F04D 29/403; F04D 29/406; F04D 29/42; F04D 29/4206; F04D 29/426; F04D 29/58; F04D 29/582; F04D 29/586; F25B 2400/01; F25B 31/002; F25B 43/00

See application file for complete search history.

(56) References Cited

U.S. PATENT DOCUMENTS 5,857,348 A * 1/1999 Conry ..... F04D 25/06 62/209
8,231,364 B2 * 7/2012 Mayer ..... F04B 17/03 417/420

(Continued)

FOREIGN PATENT DOCUMENTS

| | | |
|---|---|---|
| JP | 01019254 A * | 1/1989 |
| KR | 10-2012-0090305 | 8/2012 |
| KR | 10-2013-0024491 | 3/2013 |

OTHER PUBLICATIONS

Office Action of corresponding Korean Patent Application No. 10-2017-0095859—5 pages (dated Aug. 21, 2020).

*Primary Examiner* — Moshe Wilensky
*Assistant Examiner* — Christopher R Legendre
(74) *Attorney, Agent, or Firm* — Knobbe Martens Olson & Bear LLP

(57) ABSTRACT

An electric compressor may include: a housing part having a refrigerant inlet through which refrigerant is introduced; a boss part formed in the housing part, having a bearing installed therein to support a rotating shaft, and guiding the refrigerant to the bearing; a guide part formed in the housing part, and inducing the refrigerant introduced into the refrigerant inlet toward the boss part, while delaying the movement of the refrigerant; and a heating part mounted in the housing part, and configured to provide heat to the guide part in order to heat the refrigerant moved to the boss part.

10 Claims, 6 Drawing Sheets

(51) Int. Cl.
*F04C 29/02* (2006.01)
*F25B 31/00* (2006.01)

(52) U.S. Cl.
CPC ..... *F25B 31/002* (2013.01); *F25B 2400/01* (2013.01)

(56) References Cited

U.S. PATENT DOCUMENTS

2009/0044548 A1* 2/2009 Masoudipour ..... F04D 29/057 62/115
2014/0314551 A1* 10/2014 Koenig ..... F04D 29/403 415/170.1
2014/0341710 A1* 11/2014 Creamer ..... G05B 13/024 415/111
2019/0032974 A1* 1/2019 Oh ..... F01C 21/02

* cited by examiner

ELECTRIC COMPRESSOR

CROSS-REFERENCES TO RELATED APPLICATIONS

The present application claims priority to Korean application number 10-2017-0095859, filed on Jul. 28, 2017, which is incorporated by reference in its entirety.

BACKGROUND OF THE INVENTION

The present invention relates to an electric compressor, and more particularly, to an electric compressor which can prevent a liquid-state refrigerant from directly reaching a bearing, thereby improving the reliability of the bearing.

There are a variety of parts which have been developed to compress a refrigerant in a cooling system for a vehicle. Among the parts, the development of an electric compressor has been actively conducted. The electric compressor is roughly divided into a driver, a compressor and a controller.

The driver includes a driver housing forming the exterior thereof and a stator and rotor which are coaxially mounted in the driver housing. The compressor includes a compressor housing forming the exterior thereof and coupled to the rear of the driver housing and an orbiting scroll and fixed scroll which are mounted so as to rotate relatively to each other in the compressor housing. The controller includes a cover housing forming the exterior thereof and coupled to the front of the driver housing and various driving circuits and elements such as a printed circuit board (PCB), which are mounted in the cover housing.

Therefore, when a refrigerant is to be compressed by the electric compressor, external power is applied to the controller through a connection terminal and the like. Thus, the controller transmits an operation signal to the driver through a driving circuit and the like.

When the operation signal is transmitted to the driver, the electromagnet-type stator pressed against the inner circumferential surface of the driver housing is excited and magnetized. Then, an electromagnetic interaction between the rotor and the stator rotates the rotor at high speed.

In this way, when a rotating shaft of the driver is rotated at high speed, the orbiting scroll of the compressor coupled to the rear of the rotating shaft is rotated at high speed in synchronization with the rotation of the rotating shaft. Then, an interaction between the orbiting scroll and the fixed scroll, which are matched to face each other, compresses a refrigerant on the outer periphery of the scroll toward the center of the scroll and discharges the compressed refrigerant to a refrigerant line, the scroll being fluidly coupled from the driver to the compressor.

In this way, the electric compressor completes the series of refrigerant compressing operations, and the rotating shaft of the rotor rotated at high speed within the driver housing by the interaction with the stator of the driver is rotatably supported by the driver housing through a bearing.

At this time, since the driver housing is formed in a cylindrical shape of which only one side is opened, the driver housing has a bearing housing formed in a protruding shape to fix the bearing to the finished surface. The bearing housing surrounds the circumferential surface of the bearing mounted in an inner assembly groove.

Therefore, when the bearing is mounted in the bearing housing, the outer circumferential surface of the bearing, which is brought in contact with the assembly surface of the bearing housing, cannot be exposed to the outside, and the refrigerant stored in the driver housing may not reach the outer circumferential surface of the bearing. Thus, when heat is generated by friction with the rotating shaft of the driver rotor rotated at a high speed of 7,000 rpm during an operation of the compressor, cooling may not be effectively performed through the outer circumferential surface. In this case, the lifespan or silence of the bearing may be degraded.

In order to solve such a problem, a separate flow path may be formed in the bearing housing, such that the refrigerant can reach the bearing. However, when the liquid-state refrigerant is transferred to the bearing by an abnormal operation of the compressor, the liquid-state refrigerant may remove lubricant applied onto the bearing, thereby causing a damage of the bearing. Therefore, there is a demand for a device capable of solving the problem.

The related art of the present invention is disclosed in Korean Patent Publication No. 2013-0011634 published on Jan. 30, 2013 and entitled "Electric compressor".

SUMMARY OF THE INVENTION

Embodiments of the present invention are directed to an electric compressor which can prevent a liquid-state refrigerant from directly reaching a bearing, thereby improving the reliability of the bearing.

In one embodiment, an electric compressor may include: a housing part having a refrigerant inlet through which refrigerant is introduced; a boss part formed in the housing part, having a bearing installed therein to support a rotating shaft, and guiding the refrigerant to the bearing; a guide part formed in the housing part, and inducing the refrigerant introduced into the refrigerant inlet toward the boss part, while delaying the movement of the refrigerant; and a heating part mounted in the housing part, and configured to provide heat to the guide part in order to heat the refrigerant moved to the boss part.

The housing part may include: a finished part having one side brought in contact with the heating part, and having the boss part formed at the other side thereof; and a circumference part protruding from the edge of the finished part, and having the refrigerant inlet formed therein.

The finished part may be formed of a thermal conductive material.

Only a portion of the finished part, which is brought in contact with the heating part, may be formed of a thermal conductive material.

The boss part may include: a boss formed at the other side of the finished part so as to surround the bearing; and a boss hole formed at a portion of the boss so as to guide the refrigerant into the boss.

The guide part may include: a first guide part protruding from the other side of the finished part, and guiding the refrigerant along a long-distance path from the refrigerant inlet to the boss hole; and a second guide part protruding from the other side of the finished part, and guiding the refrigerant along a short-distance path from the refrigerant inlet to the boss hole.

The first and second guide parts may be formed in a linear protrusion shape, and protruded to a lower height than the boss part.

The heating part may be disposed between the first and second guide parts.

The first and second guide parts may have a curved surface protruding in the moving direction of the refrigerant.

The guide part may further include one or more third induction parts protruding from the first and second guide parts so as to delay the movement of the refrigerant.

The third induction part may be protruded to the same height as the first and second guide parts.

DESCRIPTION OF SPECIFIC EMBODIMENTS

Hereafter, an electric compressor in accordance with an embodiment of the present invention will be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
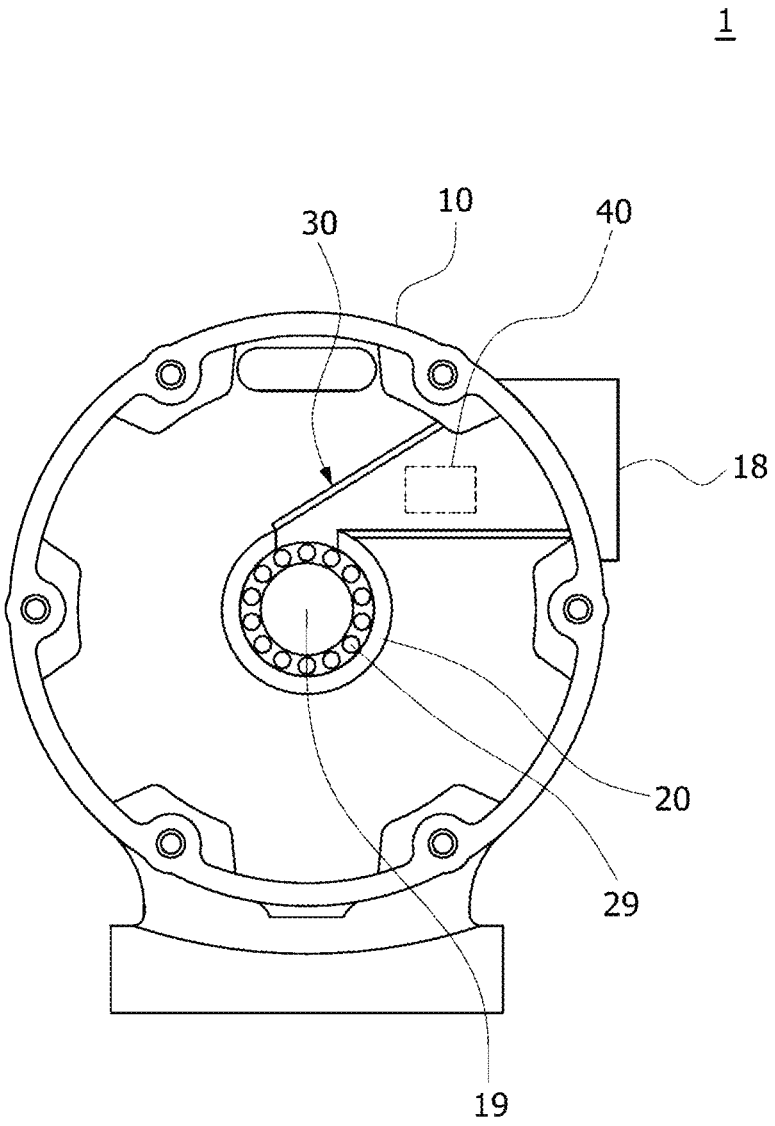
FIG. 1 schematically illustrates an electric compressor in accordance with an embodiment of the present invention.

FIG. 1 schematically illustrates an electric compressor in accordance with an embodiment of the present invention. Referring to FIG. 1, the electric compressor 1 in accordance with the embodiment of the present invention may include a housing part 10, a boss part 20, a guide part 30 and a heating part 40.

The housing part 10 may have a refrigerant inlet 18 through which a refrigerant is introduced. For example, a stator and rotor for generating rotation power of a rotating shaft 19 may be mounted in the housing part 10. The housing part 10 may include a controller mounted at one end thereof, the controller being electrically connected to the stator and configured to control the operation of the rotating shaft 19 by driving or stopping the rotator.

The boss part 20 may be formed in the housing part 10, have a bearing 29 installed therein to support the rotating shaft 19, and guide the refrigerant to the bearing 29. For example, the boss part 20 may protrude from a side surface of the housing part 10, and a part of the refrigerant flowing into the housing part 10 may reach the bearing 29 in order to cool the bearing 29.

The guide part 30 may be formed in the housing part 10, and delay and induce the refrigerant introduced through the refrigerant inlet 18 toward the boss part 20 while delaying the movement of the refrigerant. For example, the guide part 30 protruding from the housing part 10 may be disposed on the transfer path of the refrigerant which is introduced through the refrigerant inlet 18 and moved. The refrigerant discharged from the refrigerant inlet 18 may be caught by the guide part 30, and stay in the guide part 30 while forming a vortex.

The heating part 40 may be mounted in the housing part 10, and provide heat to the guide part 30 in order to heat the refrigerant moved to the boss part 20. For example, the heating part 40 may be included in the controller mounted at the end of the housing part 10. More specifically, an inverter for converting a current may be applied as the heating part 40.

Figure 2:
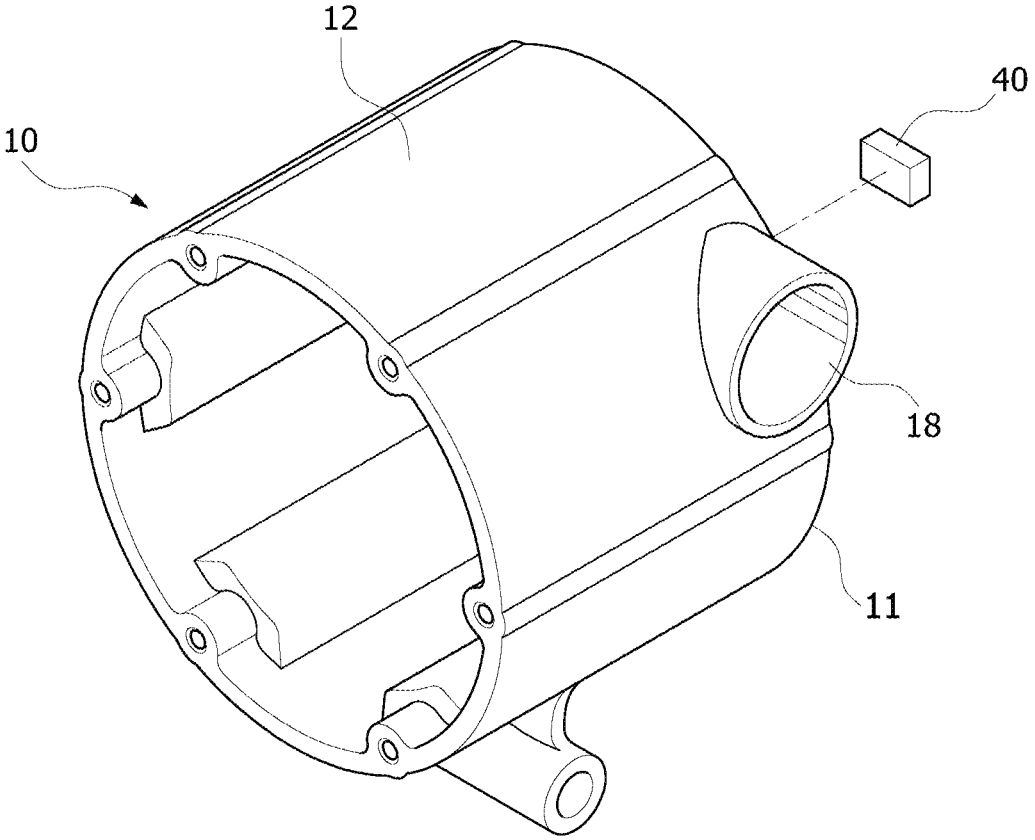
FIG. 2 schematically illustrates a housing part of the electric compressor in accordance with the embodiment of the present invention.

FIG. 2 schematically illustrates the housing part of the electric compressor in accordance with the embodiment of the present invention. Referring to FIGS. 1 and 2, the housing part 10 may include a finished part 11 and a circumference part 12.

The heating part 40 may be brought in contact with one side of the finished part 11. The boss part 20 may be formed at the other side of the finished part 11. The finished part 11 may include a thermal conductive material.

For example, the finished part 11 may be formed in a disk shape, and the heating part 40 may be brought in contact with the rear surface of the finished part 11, such that heat can be transferred to the finished part 11. The heating part 40 may be disposed in the region of the guide part 30, and only the portion of the finished part 11, which is brought in contact with the heating part 40, may be formed of a thermal conductive material.

The rotating shaft 19 may be disposed through the finished part 11, and the boss part 20 may surround the rotating shaft 19. The bearing 29 may be inserted between the rotating shaft 19 and the boss part 20, and support the rotation of the rotating shaft 19.

The circumference part 12 may protrude from the edge of the finished part 11, and the refrigerant inlet 18 may be formed in the circumference part 12. For example, the stator and rotor for generating rotation power of the rotating shaft 19 may be mounted in the circumference part 12.

Figure 3:
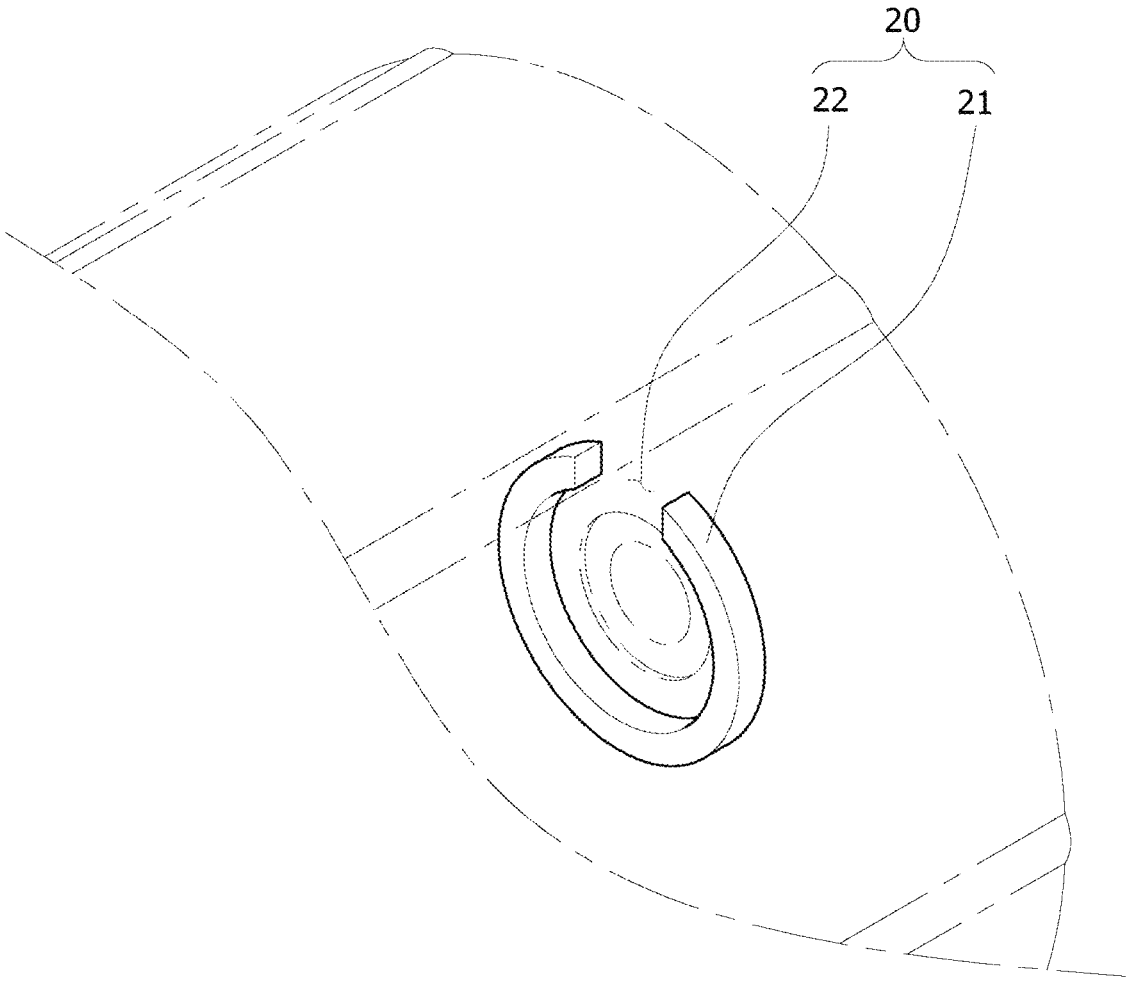
FIG. 3 schematically illustrates a boss part of the electric compressor in accordance with the embodiment of the present invention.

FIG. 3 schematically illustrates the boss part of the electric compressor in accordance with the embodiment of the present invention. Referring to FIGS. 1 to 3, the boss part 20 in accordance with the embodiment of the present invention may include a boss 21 and a boss hole 22.

The boss 21 may protrude from the other side of the finished part 11 so as to surround the bearing 29. The boss hole 22 may be formed at a portion of the boss 21, and guide the refrigerant into the boss 21.

For example, when the boss part 20 is seen from the front, the boss hole 22 may be formed at the top of the boss 21. The refrigerant inlet 18 may be located at a higher position than the boss hole 22. Therefore, the refrigerant discharged from the refrigerant inlet 18 may pass above the boss 21.

Figure 4:
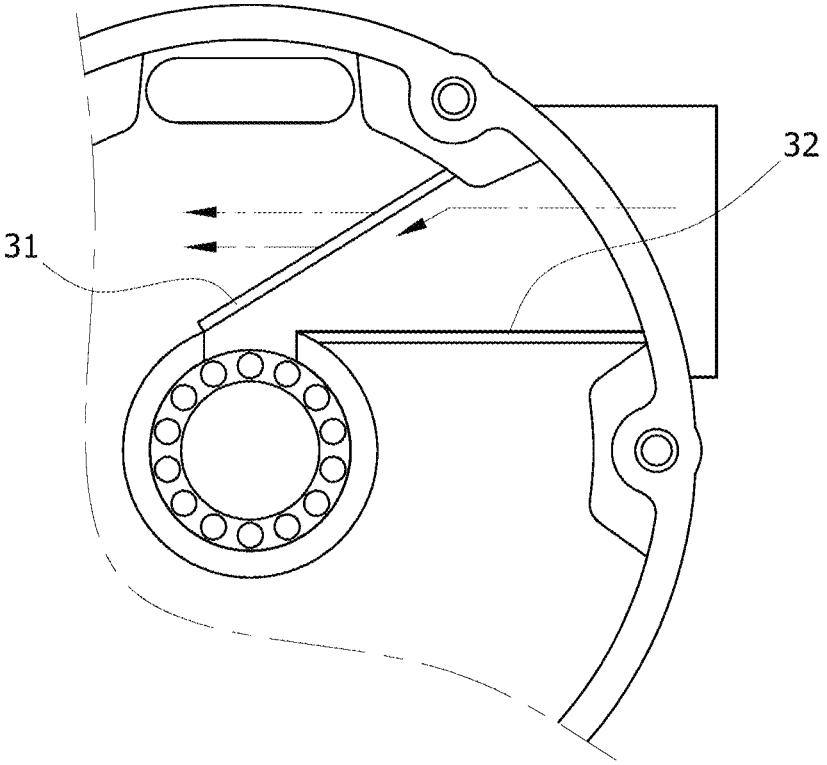
FIG. 4 schematically illustrates a guide part of the electric compressor in accordance with the embodiment of the present invention.

FIG. 4 schematically illustrates the guide part of the electric compressor in accordance with the embodiment of the present invention. Referring to FIGS. 1 to 4, the guide part 30 in accordance with the embodiment of the present invention may include a first guide part 31 and a second guide part 32.

The first guide part 31 may protrude from the other side of the finished part 11, and guide the refrigerant along a long-distance path from the refrigerant inlet 18 to the boss hole 22. The second guide part 32 may protrude from the other side of the finished part 11, and guide the refrigerant along a short-distance path from the refrigerant inlet 18 to the boss hole 22.

For example, since the first and second guide parts 31 and 32 are formed with linear protrusions and have a smaller height than the boss part 20, a part of the moved refrigerant may be caught by the first and second guide parts 31 and 32. Therefore, the refrigerant can be prevented from rapidly and excessively flowing into the boss hole 22. At this time, the heating part 40 may be disposed between the first and second guide parts 31 and 32, and heat the held refrigerant.

Figure 5:
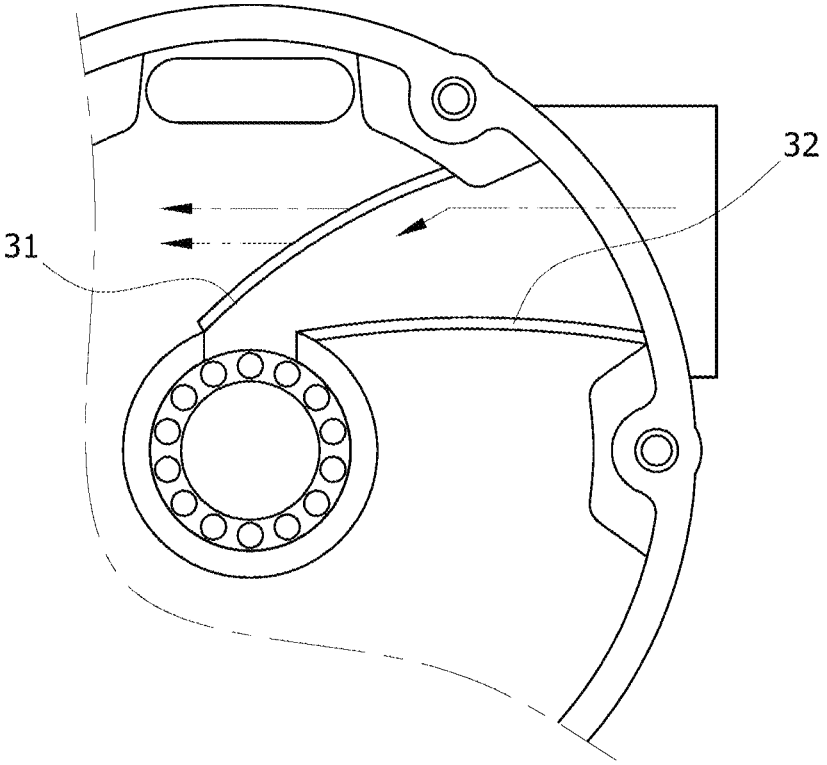
FIG. 5 schematically illustrates that the guide part of the electric compressor in accordance with the embodiment of the present invention is formed with a curved surface.

FIG. 5 schematically illustrates that the guide part of the electric compressor in accordance with the embodiment of the present invention is formed with a curved surface. Referring to FIG. 5, the first and second guide parts 31 and 32 may be formed with a curved surface. For example, the curved surfaces of the first and second guide parts 31 and 32 may be protruded in the moving direction of the refrigerant, in order to maximize the induction area for the refrigerant.

Figure 6:
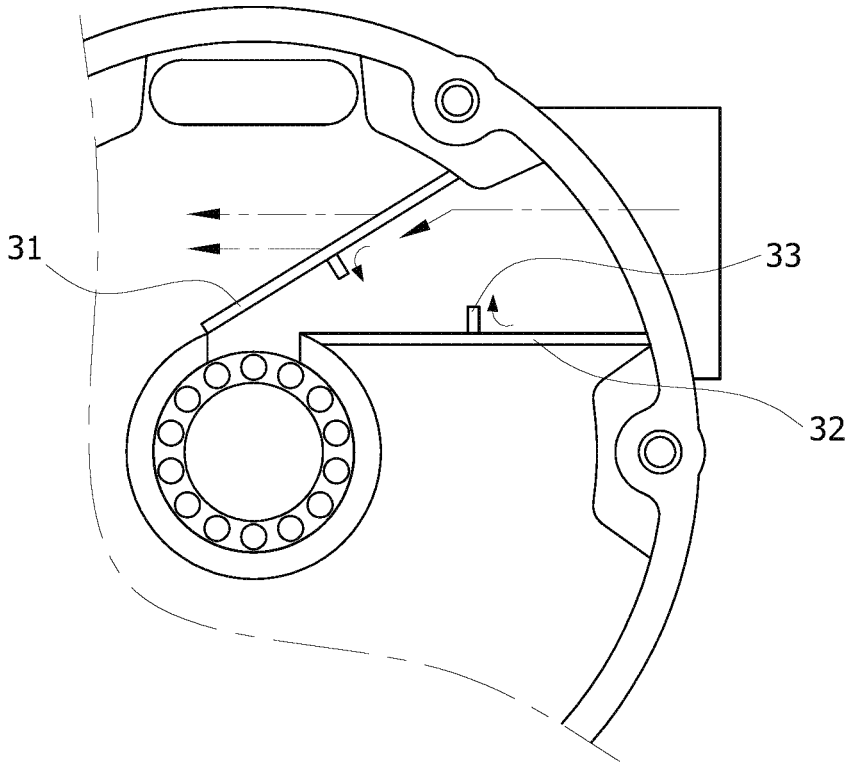
FIG. 6 schematically illustrates that a third guide part is added to the guide part of the electric compressor in accordance with the embodiment of the present invention.

FIG. 6 schematically illustrates that a third guide part is added to the guide part of the electric compressor in accordance with the embodiment of the present invention. Referring to FIG. 6, the guide part 30 in accordance with the embodiment of the present invention may further include one or more third induction parts 33.

The one or more third induction parts 33 may protrude in the longitudinal directions of the first and second guide parts 31 and 32, and delay the movement of the refrigerant. For example, the third induction part 33 may be protruded to the same height as the first and second guide parts 31 and 32.

The operation of the electric compressor in accordance with the embodiment of the present invention will be described as follows.

When the electric compressor 1 is normally operated, the gas-state refrigerant introduced into the housing part 10 through the refrigerant inlet 18 may flow into the boss part 20 through the guide part 30, and cool the bearing 29 to support the rotating shaft 19.

When the electric compressor 1 is abnormally operated to introduce the liquid-state refrigerant through the refrigerant inlet 18, the liquid-state refrigerant may be converted into the gas-state refrigerant by the heating part 40 while the movement of the liquid-state refrigerant is delayed along the guide part 30. The gas-state refrigerant may flow into the boss part 20 through the guide part 30, thereby cooling the bearing 29 to support the rotating shaft 19.

That is, when the movement of the refrigerant is delayed by the guide part 30, the heating part 40 may heat the liquid-state refrigerant caused by an abnormal operation, and convert the liquid-state refrigerant into the gas-state refrigerant.

Therefore, since the liquid-state refrigerant can be prevented from flowing into the boss part 20, the lubricant contained in the bearing 29 can be protected from the liquid-state refrigerant.

In the electric compressor 1 in accordance with the embodiment of the present invention, the refrigerant can be induced into the boss part 20 by the guide part 30, and cool the bearing 29 to support the rotating shaft 19.

Furthermore, the heating part 40 can heat the liquid-state refrigerant to convert into the gas-state refrigerant, while the movement of the liquid-state refrigerant is delayed by the guide part 30, which makes it possible to prevent a reduction in lifespan of the bearing 29.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An electric compressor comprising:

a housing part having a refrigerant inlet through which refrigerant is introduced;

a boss part formed in the housing part, having a bearing installed therein to support a rotating shaft, and guiding the refrigerant to the bearing;

one or more guide parts formed in the housing part and inducing the refrigerant introduced into the refrigerant inlet toward the boss part, while delaying movement of the refrigerant; and a heating part mounted to the housing part and configured to provide heat to the one or more guide parts in order to heat the refrigerant moved to the boss part, wherein the housing part comprises:

a finished part having a first side brought in contact with the heating part and having the boss part formed at a second side thereof; and a circumference part protruding from an edge of the finished part and having the refrigerant inlet formed therein, wherein the boss part comprises:

a boss formed at the second side of the finished part so as to surround the bearing; and a boss hole formed at a portion of the boss so as to guide the refrigerant into the boss, wherein the one or more guide parts comprises:

a first guide part protruding from the second side of the finished part and guiding the refrigerant along a long-distance path from the refrigerant inlet to the boss hole; and a second guide part protruding from the second side of the finished part and guiding the refrigerant along a short-distance path from the refrigerant inlet to the boss hole.

2. The electric compressor of claim 1, wherein the finished part is formed of a thermally conductive material.

3. The electric compressor of claim 1, wherein only a portion of the finished part, which is brought in contact with the heating part, is formed of a thermally conductive material.

4. The electric compressor of claim 1, wherein the first and second guide parts are formed in a linear protrusion shape and protruded to a lower height than the boss part.

5. The electric compressor of claim 1, wherein the heating part is disposed between the first and second guide parts.

6. The electric compressor of claim 1, wherein the first and second guide parts have a curved surface protruding in a direction of the movement of the refrigerant.

7. The electric compressor of claim 1, further comprising first and second induction parts protruding from the first and second guide parts, respectively, so as to delay the movement of the refrigerant.

8. The electric compressor of claim 7, wherein the first induction part has a height that is equal to that of the second induction part.

9. The electric compressor of claim 1, further comprising an induction part protruding from the first guide part so as to delay the movement of the refrigerant.

10. The electric compressor of claim 1, further comprising an induction part protruding from the second guide part so as to delay the movement of the refrigerant.

* * * * *